United States Patent [19]

Sylvester

[11] Patent Number: 4,697,285

[45] Date of Patent: Oct. 6, 1987

[54] BALLISTICS VEST

[75] Inventor: William Sylvester, Big Bear City, Calif.

[73] Assignee: Safariland Ballistics, Inc., Monrovia, Calif.

[21] Appl. No.: 898,372

[22] Filed: Aug. 20, 1986

[51] Int. Cl.[4] ..... A41D 13/00; F41H 1/02

[52] U.S. Cl. ..... 2/2.5; 2/2

[58] Field of Search ..... 2/2, 2.5, 102

[56] References Cited

U.S. PATENT DOCUMENTS 4,079,464 3/1978 Roggin ..... 2/2.5

4,483,020 11/1984 Dunn ..... 2/2.5

*Primary Examiner*—Doris L. Troutman

*Attorney, Agent, or Firm*—Christie, Parker & Hale

[57] ABSTRACT

A protective vest system useful as a ballistics vest includes a front panel for overlying the chest region of a user, a front carrier containing the front panel, front strap-like elastically stretchable fastening means rigidly affixed to peripheral portions of the front panel and extending to the outside of the front carrier, a rear panel for overlying the back region of a user, a rear carrier containing the rear panel, and strap-like elastically stretchable rear fasteners rigidly affixed to peripheral portions of the rear panel and extending to the exterior of the rear carrier. Cooperating fasteners on the free end portions of the front and rear strap-like fasteners are attached to one another to rigidly secure the front and rear panels to the body of the user. Each panel includes multiple layers of a flexible and foldable impact-resistant material, such as a woven Kevlar fabric, overlying one another and contained within a flexible and foldable jacket. The multiple layers are free-floating relative to one another across an area encompassing at least a major portion of the area occupied the multiple layers so that the resulting front and rear protective panels are highly flexible and therefore comfortable and light in weight during use. The rigid attachment of the front and rear fasteners solely to peripheral regions of the panels stabilizes the otherwise free-floating multiple layers of each panel sufficiently to enable the multiple layers to remain in their flat overlying and protective positions after being impacted by multiple rounds fired from different angles during conventional ballistics testing.

27 Claims, 7 Drawing Figures

BALLISTICS VEST

FIELD OF THE INVENTION

This invention relates to protective vests, and more particularly to body armor commonly known as a ballistics vest or a bullet-resistant vest.

BACKGROUND OF THE INVENTION

Ballistics vests have saved the lives of many law enforcement officers in recent years. As a result, many law enforcement agencies have now made it mandatory that their officers wear a ballistics vest while on duty.

Ballistics vests have been available in recent years as a protective panel having overlying layers of a fabric made from woven fibers known as Kevlar. Use of Kevlar fabric in ballistics vests has been successful because of the high energy absorption properties of the material. The material also is reasonably light in weight and flexible, which improves the comfort of the ballistics vest when compared with previous vests which were made of metal and were therefore heavier and more rigid. The comfort of a ballistics vest is an extremely important consideration, especially to law enforcement officers, because of the heat buildup that occurs from wearing a heavy and inflexible vest for the long hours an officer is on duty. However, the presently available ballistics vests made from Kevlar fabric have significant disadvantages.

The ballistics vest currently available offer different levels of protection depending primarily upon the overall thickness of the protective panel. Ballistics vests are subjected to ballistics testing to measure their ability to protect against projectiles fired from different types of weapons. For instance, ballistics test specifications for ballistics vests identify the weapon and caliber size, barrel length and muzzle velocity that a given vest is able to protect against. One ballistics vest is able to stop penetration from a 0.357 Magnum fired at 1400 ft/sec. More layers of Kevlar fabric may be added to a vest of offer protection against more dangerous weapons. The added protective layers, of course, add to the weight of the vest and its inflexibility, which naturally makes the vest more uncomfortable to wear, not to mention adding greater restrictions to the officer's mobility.

Ballistics vests are commonly tested by fastening them to a clay dummy and firing rounds at the vest from different angles. In one test, six rounds are fired. Two of these rounds are fired at a 30° angle. The vest is then soaked in water and the same six rounds are fired again. The water test was adopted because water can act as a lubricant, which can enhance penetration of a round; and so passing the water test is good assurance that the vest is safe.

During ballistics testing, the layers of Kevlar fabric in the vest can bunch up from the impact of a round striking the vest at an angle. If the material bunches up from an angular impact, the vest usually fails the test because of its inability to stop further rounds fired during the test. Common test procedures now do not allow the vest material to be smoothed out or the vest to be repositioned between rounds. Up to the present time, the ballistics vests that have passed the ballistics tests have been too inflexible and uncomfortable during use by a police officer.

One prior art ballistics vest that has successfully passed such tests comprises a panel formed by multiple overlying layers of Kevlar fabric. The layers of fabric are stitched together by a large bax sitich in the center of the panel using high tensile strength nylon thread. When the multiple layers of Kevlar fabric are rigidly affixed to one another in this way, the individual layers are not able to move freely relative to one another. This yields a reasonably stiff panel. The resulting panel is able to bend, but the central stitching resists flexing of the panel in all directions. As a result, the panel is relatively uncomfortable when worn because of its stiffness and resistance to flexing under normal use.

Another prior art ballistics vest that has successfully passed tests involving the firing of rounds from different angles is made from multiple Kevlar fabric panels which are laminated to one another. This ballistics vest is even more unyielding than the vest in which the Kevlar layers are stitched together.

Thus, there is a need for a ballistics vest that can pass ballisitcs testing without detracting from the comfort, flexibility and light weight of the vest.

A ballistics vest using "free-floating" layers of Kevlar fabric can provide a substantial improvement in flexibility and comfort when compared with a vest made from rigidly attached layers of fabric. The free-floating layers of Kevlar fabric are overlaid without attachment to one another and are contained within a flexible outer jacket to provide a ballistics panel. However, such a ballistics vest is not able to pass the ballistics test. A ballistics vest having multiple free-floating layers of Kevlar fabric fails the ballistics test because the freely movable panels tend to bunch up when the panel is hit with rounds fired at an angle. The bunching of the material leaves portions of the vest easily exposed to penetration by successive rounds in the test and results in a test failure.

The present invention provides a ballistics vest system which incorporates free-floating layers of ballistics material in a combination that is highly flexible and unusually comfortable to wear while the resulting ballistics vest system also withstands penetration from rounds first at different angles sufficient to pass ballistics test procedures.

SUMMARY OF THE INVENTION

Briefly, the present invention provides a protective vest system which includes an impact-resistant front panel for overlying the chest region of a user, a front carrier for containing the front panel, an impact-resistant rear panel for overlying the back of a user, a rear carrier for containing the rear panel, strap-like front fastening means rigidly affixed to the front panel and extending to the outside of the front carrier, and rear strap-like fastening means rigidly affixed to the rear panel and extending to the outside of the rear carrier. Further fastening means on the front and rear strap-like fasteners secure the fasteners together for holding the front and rear panels on the body of the user.

In one embodiment, the front and rear panels each comprise multiple layers of a flexible and foldable impact-resistant material overlying one another and contained within a flexible and foldable outer jacket. The multiple layers of impact-resistant material are free floating relative to one another across an area encompassing at least a major portion of the area occupied by the impact-resistant layers. This free-floating action of the overlying protective layers provides a highly flexible and foldable ballistics vest because the overlying protective layers are not rigidly secured to one another over a large area that will otherwise diminish the flexibility and ultimately the comfort of the vest. The strap-like fasteners used for attaching the front and rear panels to one another on the body of the user are rigidly attached to peripheral regions of the overlying and free-floating impact-resistant layers of each jacket. The strap-like fasteners extend outwardly from opposite sides of the front panel and from the rear panel to the exterior of the front and rear carriers which contain the front and rear panels. By rigidly affixing the strap-like fasteners to peripheral regions of the front and rear panels, the multiple impact-resisting layers of the front and rear vest can remain free floating and hence provide flexibility and resulting comfort of the protective vest system, while the attachment of the front and rear fasteners holds the impact-resistant layers together sufficiently to pass ballistics test procedures.

These and other aspects of the invention will be more fully understood by referring to the following detailed description and accompanying drawings.

DRAWINGS

DETAILED DESCRIPTION

Figure 2:
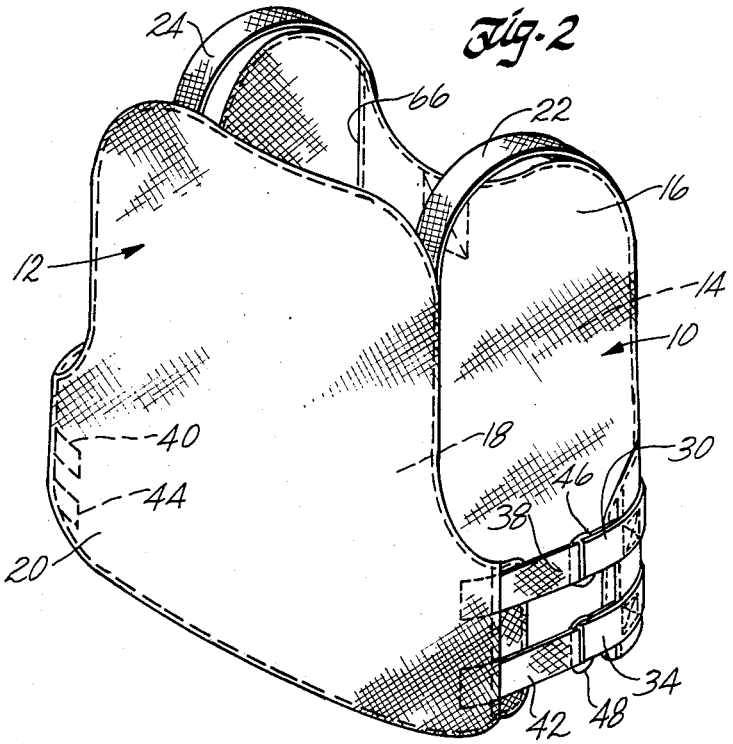
FIG. 2 is a rear perspective view of the protective vest system shown in FIG. 1.
Figure 1:
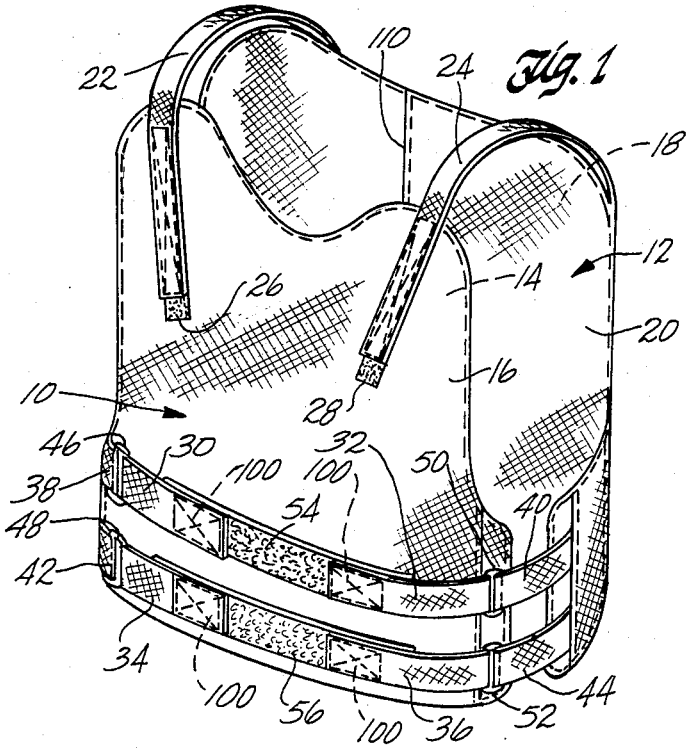
FIG. 1 is a front perspective view illustrating a protective vest system according to principles of this invention.

FIGS. 1 and 2 are perspective views illustrating the protective vest system of this invention. The invention is described in relation to its preferred use as a ballistics vest system having a front protective section 10 for overlying the chest region of the user, and a rear protective section 12 for overlying the back of a user. The right and left hand orientation of the various components of the protective vest system are described herein with respect to the right and left sides of a user wearing the vest system. The front section 10 includes a front protective panel 14 contained within a front carrier 16. Similarly, the rear section 12 includes a rear protective panel 18 contained within a rear carrier 20. A pair of flexible right and left straps 30 and 32 are fastened to right and left shoulder regions, respectively, of the rear carrier 20. The straps extend over the right and left shoulders of the user for attachment to corresponding right and left fasteners 26 and 28 on outer front portions of the front jacket 16. An upper pair of right and left strap-like fasteners 30 and 32 affixed to right and left sides of the front panel 14 contained within the front carrier 16 extend to the exterior of the front carrier. A lower pair of right and left strap-like fasteners 34 and 36 are affixed to the front panel 14 below the pair of upper fasteners. This leaves the flexible free-end portions of the upper and lower pairs of strap-like fasteners extending parallel to one another from the right and left sides of the front panel to the exterior of the front carrier.

An upper pair of short flexible straps 38 and 40 are affixed to right and left sides of the rear panel 18. Similarly, a lower pair of short flexible straps 42 and 44 are rigidly affixed to right and left sides of the rear panel 18. This leaves the short flexible free ends of the upper and lower straps extending parallel to one another from the right side of the rear panel 18, and short flexible free-end portions of the upper and lower left straps extending parallel to one another from the left side of the rear panel. The ends of the short straps 38 and 42 on the right hand side of the rear panel carry upper and lower D-rings 46 and 48. The free ends of the short flexible straps 40 and 44 on the left side of the rear panel also carry upper and lower left D-rings 50 and 52.

The front and rear panel sections are attached at their bottom by threading the free ends of the upper and lower straps on the right hand side of the front panel through the corresponding right D-rings, and then folding the ends of the upper and lower right straps back on themselves for attachment to upper and lower right fasteners 54 and 56 on the front of the front carrier 16. Similarly, the free ends of the upper and lower straps on the left hand side of the front panel are threaded through corresponding left D-rings, and the ends of the upper and lower left straps are then folded back on themselves for attachment to right hand portions of the upper and lower fasteners 54 and 56 on the front carrier. The left-hand straps are folded back on themselves for attachment to left-hand portions of upper and lower fasteners 54 and 56, respectively.

Figure 3:
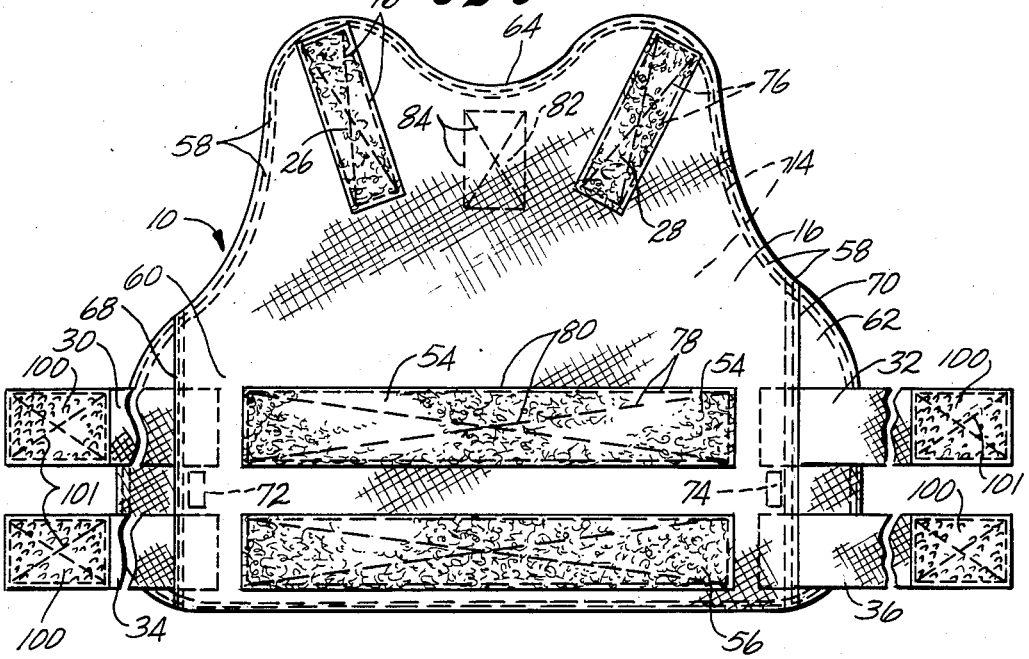
FIG. 3 is a fragmentary front elevation showning a front carrier containing a front protective panel.
Figure 6:
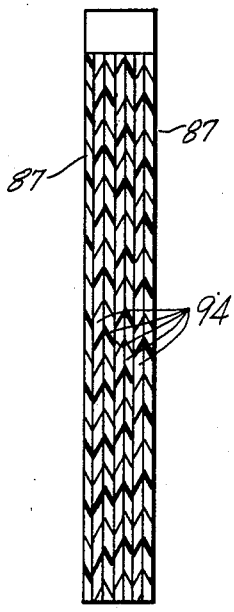
FIG. 6 is an enlarged cross-sectional view taken on line 6—6 of FIG. 5.
Figure 5:
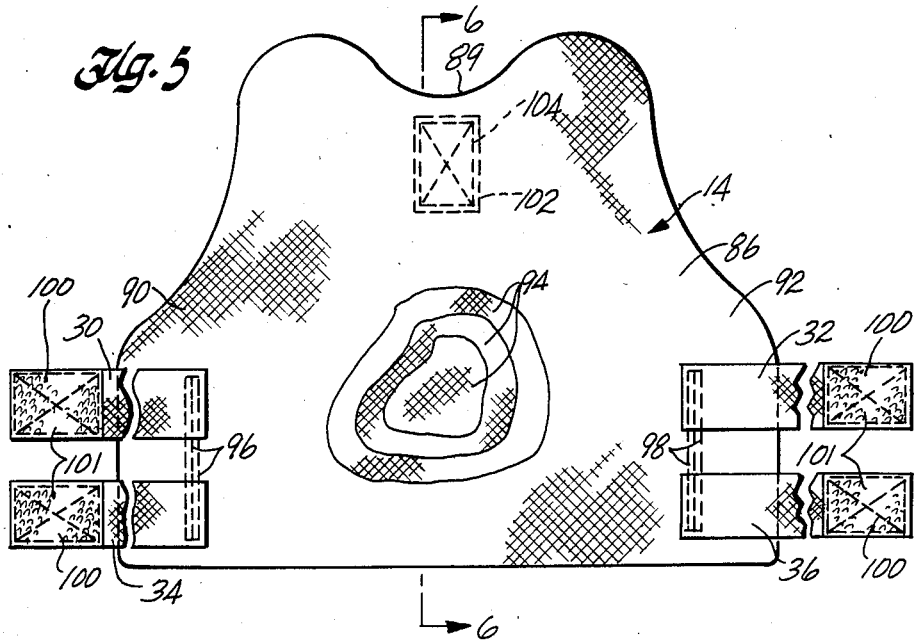
FIG. 5 is a front elevation view showing a front panel in which a portion of the view is partially broken away to illustrate multiple impact-resistant layers contained within the front panel.

Detailed construction of the front protective section 10 is understood best by referring to the front carrier 16 illustrated in FIG. 3 and the front protective panel 14 illustrated best in FIGS. 5 and 6.

The outer front carrier 16 comprises a flexible and foldable jacket made from overlying layers of a washable woven fabric such as cotton. The overlying layers are fastened together by peripheral stitching 48. The carrier is shaped and sized so as to cover the chest region of the user. Right and left side sections 60 and 62 project from the lower sides of the carrier for covering the upper torso below the arms of the user. A recessed front region 64 of the carrier fits under the user's neck. The inside face of the carrier actually comprises two side-by-side sheets of fabric which vertically overlap along the inside face of the front carrier to form a long opening 66 of a pocket formed inside the carrier. The front protective panel 14 can be inserted into the interior of the carrier through the opening 66 which is shown best in FIG. 2.

A pair of right and left openings 68 and 70 to the interior of the front carrier 16 are formed on the right and left side portions 60 and 62 of the carrier. These openings are formed by cutting the outside face of the carrier along vertical lines inboard from the inside face of the carrier. The inside and outside faces overlie one another to form the right and left openings to the interior of the front carrier. The right and left openings 68 and 70 allow for passage of the right strap-like fasteners 30 and 34 and the left strap-like fasteners 30 and 32 from the front protective panel 14 inserted into the front carrier. Cooperating Velcro fasteners 72 and 74 on opposite faces of carrier form small releasable fastening means to close the center portions of the openings 68 and 70 between the pair of right straps 30 and 34, and between the pair of left straps 32 and 36, respectively.

The fasteners 26 and 28 on the front carrier 16 are preferably elongated strips of a Velcro pile type material extending downwardly at an angle over the front shoulder regions of the carrier. These fasteners are secured to the front face of the carrier by box stitching 76.

The upper and lower fasteners 54 and 56 are preferably elongated strips of a Velcro pile type material extending parallel to one another across most of the width of the carrier. These upper and lower fasteners are box-stitched at 78 and 80.

A Velcro fastener 82 is fastened to the inside of the rear face of the front carrier immediately below the neck recess 64. This fastener is preferably a short rectangular Velcro pile type material secured to the carrier by box stitching 84.

The stitching described above preferably is provided by high tensile strength fibrous materials such as nylon.

Referring to FIG. 5, the front protective panel 14 comprises a flexible and foldable outer jacket 86, preferably made from high tensile strength woven fabric such as ballistic nylon. Alternatively, the jacket can be made from combined woven cotton and nylon fibers. The outer jacket comprises an inner face 87 and an outer face 88 (see FIG. 6) of the ballistic nylon material overlying one another and secured together by peripheral stitching to form a closed hollow interior spaced inside the outer jacket. The jacket 86 has a size and shape that match the front carrier 16 so that jacket can be inserted into the carrier. Thus, the jacket includes the recessed neck region 89 and the right and left projecting side portions 90 and 92. The interior of the jacket 86 contains multiple layers 94 of a flexible and foldable impact-resistant material such as high tensile strength woven Kevlar fabric. The layers of Kevlar fabric overlie one another and are of a size and shape to match the interior of the outer jacket 86. The number of layers of Kevlar fabric contained in the outer jacket of the ballistics panel depends upon the desired level of ballistic protection. In one embodiment, the ballistics panel comprises 20 separate layers of Kevlar fabric which in the aggregate are about ¼ thick. This vest is capable of stopping a round fired from a 0.357 Magnum at point-blank range.

The layers of Kevlar fabric are left free floating within the interior of the outer jacket. That is, the layers are each freely movable with respect to one another within the jacket, without being laminated to each other or otherwise bonded to one another in a face-to-face relation. It is important that the individual layers of Kevlar fabric be free floating within an area at least encompassing most of the surface area occupied by the overlying layers. In the illustrated embodiment, the layers of Kevlar fabric are free floating within a large area occupying the centralmost portion of the protective panel. This free floating relation makes the resulting ballistics panel highly flexible and foldable which, in turn, enhances the comfort of the ballistics panel when worn. Stitching in the central region of the panel extending through the entire depth of the panel greatly increases the stiffness of the panel and makes it too uncomfortable to wear, from the point of view that the panel generally produces too much heat and is too much of a restriction to the user's mibility.

Referring again to FIG. 5, the pair of right straps 30 and 34 are secured to the front face of the bullet proof panel 14 by vertical rows of nylon stitching 96. Similarly, the left straps 32 and 36 are secured to the front face of the panel by vertical rows of nylon stitching 98. The stitching extends through the entire depth of the ballistics panel, including through opposite faces of the outer jacket and through all layers 94 of the Kevlar fabric. The right and left pairs of straps are secured to the jacket only in the peripheral regions of the panel, namely, on the projecting side portions 90 and 92. Thus, the Kevlar fabric layers remain free floating within the area encompassing essentially the entire front portion of the upper torso of the user. The pairs of right and left flexible straps are preferably made from an elastically stretchable material. The free end portions of the straps have corresponding elongated Velcro hook fasteners 100. Box stitching 101 fastens the Velcro hook fasteners to the ends of the straps.

A small Velcro hook fastener 102 is also secured to the rear face of the front panel 14 by box stitching 104 extending through the entire depth of the panel. This fastener is used by attaching it to the fastener 82 on the inside of the front carrier after the front panel is placed inside the front carrier. This assists in holding the front panel in a fixed position within the front carrier during use.

Figure 4:
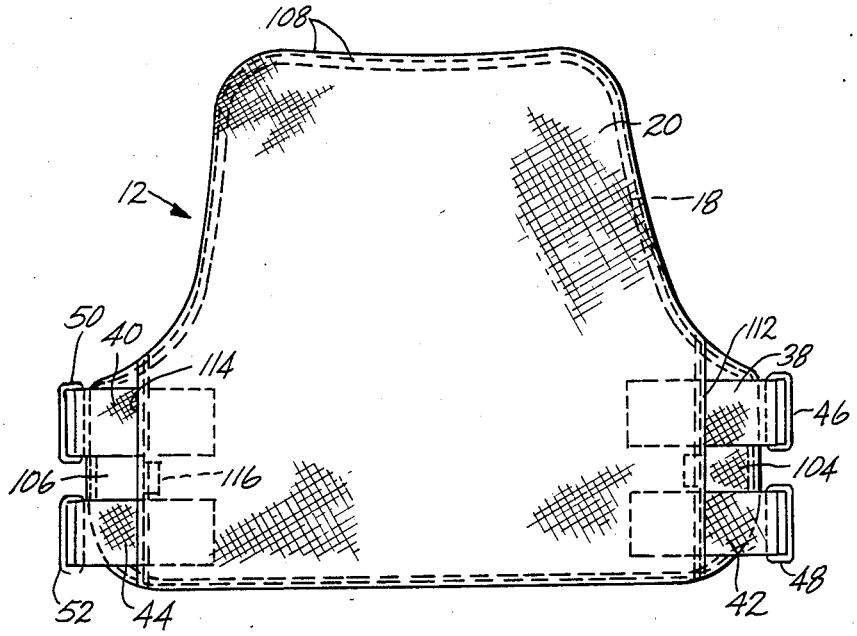
FIG. 4 is a front elevation view showing a rear carrier containing a rear protective panel.

Referring to FIG. 4, the rear carrier 20 preferably comprises a flexible and foldable outer jacket made from a washable fabric such as cotton. The carrier 20 is sized and shaped to fit over the area encompassing most of the user's back. The carrier also has right and left projecting side portions 104 and 106 for extending around the sides of the user. The carrier 20 is made from overlying front and rear faces of the fabric secured together by peripheral stitching 108. The inner face is actually formed by two separate unattached faces for forming a vertical opening 110 (see FIG.1) to the hollow interior of the carrier. Vertical openings 112 and 114 also are formed on the right and left side portions 104 and 106, respectively, of the carrier. These provide spaces through which the pair of upper straps 38 and 40 and the pair of lower straps 42 and 44 extend to the exterior of the carrier from the rear ballistics vest contained within the carrier. Small Velcro fasteners 116 fasten center portions of the openings 112 and 114 between the upper pair of straps and the lower pair of straps.

Figure 7:
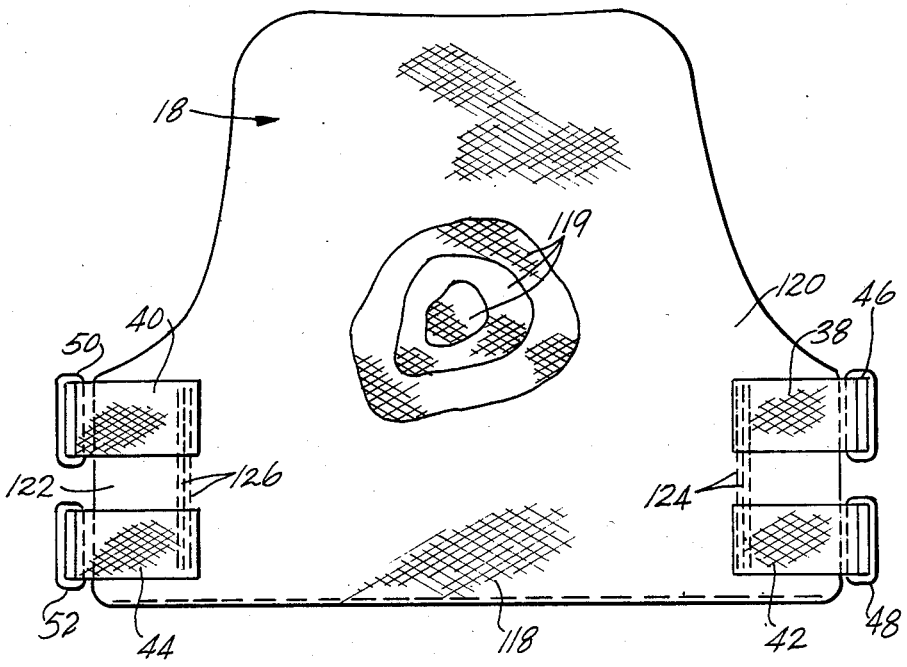
FIG. 7 is a front elevation view showing a rear protective panel in which a portion of the view is partially broken away to illustrate multiple impact-resistant layers contained within the rear panel.

Referring to FIG. 7, the rear protective panel 18 comprises a flexible and foldable outer jacket 118 preferably made from ballistic nylon. The outer jacket comprises an inner face and an outer face of the ballistic nylon fabric overlying one another and secured together by peripheral stitching to form a hollow interior space inside the closed jacket. The jacket has a size and shape which match the rear carrier so that the rear jacket can be inserted into the interior space within the rear carrier. Thus, the jacket 118 is sized and shaped to cover most of the back region of the user and includes right and left projecting side portions 120 and 122 for extending around the sides of the user. The interior of the rear jacket contains multiple layers 119 or the flexible and foldable impact-resistanct high tensile strength woven Kevlar fabric. The layers of fabric contained within the rear jacket overlie one another and are of a size and shape to match the interior of the jacket 118. The number of layers of Kevlar fabric contained in the rear ballistics panel can depend upon the desired level of protection. The layers of Kevlar fabric are free-floating within the interior of the jacket so that all layers are freely movable with respect to one another within the jacket over an area encompassing at least the majority of the space occupied by the individual Kevlar fabric layers. This occupied space is preferably similar to the area covering most of the back region of the user. As described previously, this free floating arrangement of Kevlar layers makes the resulting ballistics panel highly flexible and foldable and therefore extremely comfortable when compared with a ballistics vest in which the Kevlar layers are stiffened by stitching in the central portion of the vest. The pairs of upper straps 38 and 40 and lower straps 42 and 44 are secured to the outer face of the rear ballistics panel by vertical rows of nylon stitching 124 and 126 on the right and left side portions 120 and 122 of the panel. this stitching extends through the entire depth of the panel for rigidly securing the staps only to peripheral portions of the rear panel, leaving the overlying separate Kevlar fabric layers 119 free floating within essentially the entire area encompassed by the rear panel. The pairs of upper straps and lower straps fastened to the rear ballistics panel are mode from an elastically stretchable material.

The D-rings at the free ends of the staps carried on the rear ballistics panel provide a means for fastening to the corresponding straps on the front ballistics panel, so that all straps can be tensioned around the body of the user and held in tension during use. Since the straps are rigidly attached to the ballistics panels at the front and rear of the ballistics vest system, and since the panels are able to be held in a flat overlying position on the front and back of the user bacause of the elastically stretchable tensioning from the front and rear straps, the free floating panels are able to remain in a fixed position relative to one another after being impacted from rounds fired at different angles.

The vest has successfully passed over 70 ballistics tests, including firing rounds at different angles and the water test, without any failures. The vest resists any tendency for the free-floating Kevlar panels to become bunched up inside the outer jacket after the panel is impacted from rounds first at an angle. The vest system also is highly flexible and comfortable for the user without restricting mobility during use. Although the invention has been described in relation to its use as a ballistics vest, it can also be used for other applications requiring protection from impact, such as in preventive gear worn to protect the user from injury.

What is claimed is:

1. A protective vest system comprising:

a front panel for overlying the chest region of a user and having multiple front layers of a flexible and foldable impact-resistant material overlying one another and contained within a flexible and foldable front jacket so that the front layers are free-floating relative to one another within the front jacket to thereby provide a flexible and foldable front panel;

elongated flexible and foldable strap-like front fasteners rigidly affixed to peripheral regions of the overlying front layers of the front panel, so the front fasteners extend freely from opposite sides of the front panel;

a front carrier of a flexible and foldable material containing the front panel with the front fasteners extending from the contained front panel to the exterior of the front carrier;

a rear panel for overlying the back of a user, the rear panel having multiple rear layers of a flexible and foldable impact-resistant material overlying one another and contained within a flexible and foldable rear jacket such that the multiple rear layers are free-floating relative to one another within the rear jacket to thereby provide a flexible and foldable rear panel;

elongated flexible and foldable strap-like rear fasteners rigidly affixed to a peripheral regions of the overlying rear layers of the rear panel, so the rear fasteners extend freely from opposite sides of the rear panel;

a rear carrier of a flexible and foldable material containing the rear panel with the rear fasteners extending from the contained rear panel to the exterior of the rear carrier; and cooperating fastening means on the free end portions of the front and rear fasteners for securing the front and rear panels to the body of a user, thereby maintaining the front and rear panels in a comfortable, flexible condition on the chest and back regions of the user while the attachments of the front and rear fasteners to the front and rear panels, respectively, maintain the multiple overlying impact-resistant layers therein in a fixed position sufficient to absorb impact substantially without disturbing the overlying relation of the free-floating layers.

2. A ballistics vest system comprising:

a front panel for overlying the chest region of a user, the front panel having multiple front layers of a flexible and foldable impact-resistant material overlying one another and contained within a flexible and foldable front jacket, such that the multiple front layers are free-floating relative to one another across an area encompassing at least a major portion of the area occupied by said front layers so that the free-floating front layers provide a flexible and foldable front panel;

elongated flexible and foldable strap-like front fasteners ridiidly affixed to peripheral regions of the front impact-resistant layers to inhibit relative movement of the overlying front layers at the point of attachment of the front fasteners, with free end portions of the front fasteners extending freely from opposite sides of the front panel;

a front carrier of a flexible and foldable material containing the front panel with the front fasteners extending from the contained front panel to the exterior of the front carrier;

a rear panel for overlying the back of a user, the rear panel having multiple rear layers of flexible and foldable impact-resistant material overlying one another and contained within a flexible and foldable rear jacket, such that the multiple rear layrs are free-floating relative to one another across an area encompassing at least a major portion of the area occupied by said rear layers so that the free-floating rear layers provide a flexible and foldable rear panel;

elongated flexible and foldable strap-like rear fasteners rigidly affixed to peripheral regions of the rear impact-resistant layers to inhibit relative movement of the rear impact-resistent layers at the point of attachment of the rear fasteners, free end portions of with the rear fasteners extending freely from opposite sides of the rear panel;

a rear carrier of a flexible and foldable material containing the rear panel with the rear fasteners extending freely from the contained rear panel to the exterior of the rear carrier; and cooperating fastening means on the free end portions of the front and rear fasteners for releasably securing the front and rear panels to the chest and back regions of a user for maintaining the flexibility and free-floating condition of the front and rear panels on said chest and back regions of the user while the attachment of the fasteners to the front and rear panels stabilizes the multiple overlying front and rear layers of the panels sufficiently to pass ballistics testing of the ballistics vest sytem.

3. Apparatus according to claim 1 in which the front and rear fasteners comprise elongated elastically stretchable straps for applying the front and rear panels around the body under tension.

4. Apparatus according to claim 3 in which the front and rear fasteners are secured solely to the peripheral regions of the panels and are secured thereto through the depth of the impact-resistant layers, leaving the overlying separate impact resistant layers free-floating separate impact-resistance layers within essentially the remaining entire area encompassed by the front and rear panels.

5. Apparatus according to claim 4 in which the front and rear fasteners extend freely through the front and rear carriers, respectively, to the exterior of the protective vest system.

6. Apparatus according to claim 1 in which the front and rear fasteners extend freely through the front and rear carriers, respectively, to the exterior of the protective vest system.

7. Apparatus according to claim 1 in which the front and rear fasteners are secured solely to the peripheral regions of the panels, leaving the overlying separate impact-resistant layers free-floating within essentially the remaining entire area encompassed by the front and rear panels.

8. Apparatus according to claim 1 in which the front panel comprises projecting left and right side portions near the peripheral bottom portion of the panel for extending under the arm regions of the user; and in which the front fasteners are secured solely to the left and right projecting side portions of the panel, through the depth of the impact-resistant layers, leaving the overlying separate impact-resistant layers free-floating within essentially the remaining entire area encompassed by the front panel.

9. Apparatus according to claim 8 in which the rear panel also comprises projecting left and right side portions near the peripheral bottom portion of the rear panel for extending under the arm regions of the user; and in which the rear fasteners are secured solely to the left and right projecting side portions of the rear panel, through the depth of the impact-resistant layers, leaving the overlying separate impact-resistant layers free-floating within essentially the remaining entire area encompassed by the rear panel.

10. Apparatus according to claim 1 in which the impact-resistant panels are made from high tensile strength woven fabric having ballistics-resistant properties.

11. Apparatus according to claim 1 in which the multiple impact-resistant layers are free-floating inside the front jacket within an area encompassing at least the majority of the surface area occupied by the overlying layers.

12. Apparatus according to claim 11 in which the multiple impact-resistant layers are free-floating within a large area occupying the centralmost portion of the protective panel.

13. Apparatus according to claim 2 in which the front and rear fasteners comprise elongated elastically stretchable straps for applying the front and rear panels around the body under tension.

14. Apparatus according to claim 13 in which the front and rear fasteners are secured solely to the peripheral regions of the front and rear panels and are secured through the depth of the impact-resistant layers, leaving the overlying separate impact-resistant layers free-floating within essentially the remaining entire area encompassed by the front and rear panels.

15. Apparatus according to claim 14 in which the front and rear fasteners extend freely through the front and rear carriers, respectively, to the exterior of the ballistics vest system.

16. Apparatus according to claim 2 in which the front and rear fasteners extend freely through the front and rear carriers, respectively to the exterior of the ballistics vest sytem.

17. Apparatus according to claim 2 in which the front and rear fasteners are secured solely to the peripheral regions of the panels, leaving the overlying separate impact-resistant layers free-floating within essentially the remaining entire area encompassed by the front and rear panels.

18. Apparatus according to claim 2 in which the front panel comprises projecting left and right side portions near the peripheral bottom portion of the front panel for extending under the arm regions of the user; and in which the front fasteners are secured solely to the left and right projecting side portions of the front panel, leaving the overlying separate impact-resistant front layers free-floating within essentially the remaining entire area encompasses by the front panel.

19. Apparatus according to claim 18 in which the rear panel comprises projecting left and right side portions near the peripheral bottom portion of the rear panel for extending under the arm regions of the user; and in which the rear fasteners are secured solely to the left and right projecting side portions of the rear panel, leaving the overlying separate impact-resistant rear layers free-floating within essentially the remaining entire area encompassed by the rear panel.

20. Apparatus according to claim 2 in which the impact-resistant panels are made from high tensile strength woven fabric having ballistics-resistant properties.

21. Apparatus according to claim 2 in which the impact-resistant panels are free-floating within a large area occupying the centralmost portion of the protective panels.

22. A ballistics vest for being worn on the chest region of a user as part of a ballistics vest system having a rear panel for overlying the back region of the user and rear fastening means on the rear panel for attachment to cooperating fastening means on the ballistics vest for use in securing the ballistics vest system to the body of the user, the ballistics vest comprising:

a front panel for overlying the chest region of the user, the front panel having multiple front layers of a flexible and foldable impact-resistant material overlying one another and contained within a flexible and foldable front jacket such that the multiple front layers of impact-resistant material are free-floating relative to one another across an area encompassing at least a major portion of the area occupied by said front layers so that the free-floating front layers provide a flexible and foldable front panel;

front fasteners rigidly affixed to peripheral regions of the front impact-resistant layers to inhibit relative movement of the overlying layers at the point of attachment of the front fasteners; and cooperating fastening means for releasably securing the front fasteners to the rear fastening means on the rear panel for releasably securing the front panel to the chest region of the user for maintaining the flexibility and free-floating condition of the muliple impact-resistant front layers on the chest region of the user while the attachment of the front fasteners means to the front panel stabilizes the multiple overlying front layers of the front panel sufficiently to pass ballistics testing of the ballistics vest.

23. Apparatus according to claim 22 in which the front fasteners comprise elongated elastically stretchable straps for securing the front panel to the body under tension.

24. Apparatus according to claim 22 in which the front fasteners are secured solely to the peripheral regions of the front panel, leaving the overlying separate impact-resistant front layers free-floating within essentially the remaining entire area encompassed by the front panel.

25. Apparatus according to claim 22 in which the front panel comprises projecting left and right side portions near the peripheral bottom portion of the panel for extending under the arm regions of the user; and in which the front fasteners are secured solely to the left and right projecting side portions of the front panel, through the depth of the impact-resistant layers, leaving the overlying separate impact-resistant front layers free-floating within essentially the remaining entire area encompassed by the front panel.

26. Apparatus according to claim 22 in which the panels are made from higher tensile strength woven fabric having ballistics-resistanct properties.

27. Apparatus according to claim 22 in which the impact-resistant panels are free-floating within a large area occupying the centralmost portion of the front panel.

* * * * *

UNITED STATES PATENT AND TRADEMARK OFFICE

CERTIFICATE OF CORRECTION

PATENT NO. : 4,697,285

DATED : October 6, 1987

INVENTOR(S) : William Sylvester

It is certified that error appears in the above-identified patent and that said Letters Patent is hereby corrected as shown below:

In the Abstract:
Line 20, after "occupied" insert --by--.

In the Specification:
Column 1, line 40, after "vest" change "of" to --to--. Column 2, line 1, change "bax" to --box--; line 19, change "light weight" to --lightweight--; line 39, delete "first" and insert therefor --fired--. Column 3, line 27, change "showning" to --showing--; line 36, change "line" to --lines--. Column 5, line 29, before "jacket" delete "that" and insert therefor --the--; line 55, change "centralmost" to --central-most--; line 64, change "mibility" to --mobility--. Column 6, line 59, change "impact-resistanct" to --impact-resistant--. Column 7, line 13, at the beginning of the sentence change "this" to --This--; line 15, change "staps" to --straps--; line 19, change "mode" to --made--; line 21, change "staps" to --straps--; line 39, delete "first" and insert therefor --fired--.

In the Claims:
Column 8, line 6, before "peripheral" delete --a--; line 52, change "layrs" to --layers--; line 61, change "impact-resistent" to --impact-resistant--; line 63, after "of" delete "with". Column 9, line 21, before "within essentially" delete "separate impact-resistance layers". Column 10, line 1, change "centralmost" to --central-most--; line 36, change "encompasses" to --encompassed--; line 52, change "centralmost" to --central-most--.

UNITED STATES PATENT AND TRADEMARK OFFICE

CERTIFICATE OF CORRECTION

PATENT NO. : 4,697,285

DATED : October 6, 1987

INVENTOR(S) : William Sylvester

It is certified that error appears in the above-identified patent and that said Letters Patent is hereby corrected as shown below:

Column 12, line 19, change "ballistics-resistanct" to --ballistics-risistant--; line 22, change "centeralmost" to --central-most--.

Signed and Sealed this

Twentieth Day of September, 1988

*Attest:*

DONALD J. QUIGG

*Attesting Officer*

*Commissioner of Patents and Trademarks*